US005903655A

United States Patent [19]

Salmi et al.

[11] Patent Number: 5,903,655

[45] Date of Patent: May 11, 1999

[54] COMPRESSION SYSTEMS FOR HEARING AIDS

[75] Inventors: Peter T. Salmi, Minneapolis; Thomas A. Scheller, Fridley, both of Minn.

[73] Assignee: Telex Communications, Inc., Minneapolis, Minn.

[21] Appl. No.: 08/734,796

[22] Filed: Oct. 23, 1996

[51] Int. Cl.[6] ..... H04R 25/00

[52] U.S. Cl. ..... 381/321; 381/312

[58] Field of Search ..... 381/68, 68.2, 68.4, 381/107, 106, 312, 313, 314, 316, 317, 320, 321

[56] References Cited

U.S. PATENT DOCUMENTS

| | | | |
|---|---|---|---|
| 4,170,720 | 10/1979 | Killion | 179/107 |
| 4,508,940 | 4/1985 | Steeger | 179/107 |
| 4,718,099 | 1/1988 | Hotvet | 381/68.4 |
| 4,891,837 | 1/1990 | Walker et al. | 379/390 |
| 5,027,410 | 6/1991 | Williamson et al. | 381/68.4 |
| 5,070,527 | 12/1991 | Lynn | 379/395 |
| 5,111,506 | 5/1992 | Charpentier et al. | 381/68.4 |
| 5,144,675 | 9/1992 | Killion et al. | 381/68.4 |
| 5,165,017 | 11/1992 | Eddington et al. | 381/68.4 |
| 5,255,325 | 10/1993 | Ishimitsu et al. | 381/107 |
| 5,278,912 | 1/1994 | Waldhauer | 381/106 |
| 5,285,502 | 2/1994 | Walton et al. | 381/94 |
| 5,303,306 | 4/1994 | Brillhart et al. | 381/68 |
| 5,404,115 | 4/1995 | Johnson | 330/279 |
| 5,422,602 | 6/1995 | Werrbach | 330/281 |
| 5,550,923 | 8/1996 | Hotvet | 381/72 |

OTHER PUBLICATIONS

Gennum, DynamEQ–1, "Understanding Twin Average Detection", pp. 1–8, Jun. 1995.

Steve Armstrong, "The Dynamics of Compression: Some Key Elements Explored," published in the Nov. 1993 issue of *The Hearing Journal* .

Harry Teder, "Hearing Instruments in Noise and the Syllabic Speech–to–NoiseRatio," published in vol. 42, No. 2 of *Hearing Instruments* .

Mead C. Killion, "The K–Amp Hearing Aid," published in vol. 2, No. 2 of the *American Journal of Audiology* .

*Primary Examiner*—Curtis A. Kuntz
*Assistant Examiner*—Rexford N. Barnie
*Attorney, Agent, or Firm*—Fredrikson & Byron, P.A.

[57] ABSTRACT

A hearing aid circuit using an averaging detector and a plurality of time constants to produce a compression control signal to control the gain of a compression amplifier which compresses an input signal when the averaging detector signal exceeds a predetermined threshold. The compression control signal has an attack and release time. The release time of the compression control signal is proportional to the duration of time during which the averaging signal's amplitude exceeds the predetermined threshold level. The release has a variable recovery rate. The recovery rate is relatively fast during an initial portion of the release time and relatively slower during the remaining portion of the release time. The hearing aid circuit may also use a volume control to adjust the gain of the signal produced by the compression amplifier without adjusting the gain of the signal produced by a linear amplifier to provide volume control for soft sounds independent of loud sounds.

57 Claims, 12 Drawing Sheets

COMPRESSION SYSTEMS FOR HEARING AIDS

TECHNICAL FIELD

The present invention relates to hearing aids, and in particular, to automatic gain control circuits employed in hearing aids.

BACKGROUND OF THE INVENTION

The audible range of many hearing impaired individuals is compressed to a limited dynamic range of sound. For such individuals, soft sounds may be inaudible while loud sounds are heard at the same sound level as persons with normal hearing.

Electronic devices which employ automatic gain control (AGC) circuitry to compensate for these hearing deficiencies are well known. These devices are often designed to compress the sound level delivered to their users by providing greater amplifier gain for soft sounds and reduced gain for loud sounds.

The response time of AGC's is commonly characterized by two parameters, the attack and release time, which are defined by the American National Standards Institute (ANSI). The attack time is defined as the time between the input signal's abrupt increase from 55 to 80 Db and the point where the output level has decreased and stabilized to within 2 dB of the steady value for the 80 dB input sound pressure level (SPL). The release time is defined as the interval between the input signal's abrupt drop from 80 to 55 dB and the point where the signal has increased and stabilized to within 2 dB of the steady state value for the 55 dB input sound pressure level.

A common problem with AGC's employed in hearing aid compression systems is that no single choice of attack and release time adequately compensates for all signals. For instance, a circuit with both a fast attack and release time frequently causes audible "pumping" of the input signal. Conversely, too long a release time will produce audible gaps, especially if the input signal contains short transients resulting in long periods of reduced gain. Attack and release times of 10 ms and 200 ms, respectively, have been used in prior art hearing aids to minimize audible pumping of the input signal.

Various solutions attempting to solve this problem have been proposed. For example, U.S. Pat. No. 4,718,099 issued Jan. 5, 1988 to Hotvet discloses the use of peak detectors in a hearing aid circuit to provide faster attack and slower release times. Peak detectors can sense signal peaks, such as the breaking of glass or sounding of a horn, and quickly reduce amplifier gain. Moreover, peak detectors allow for setting a variable release time independent of the attack time and dependent upon the longevity of the input peak.

It is believed that the human ear does not respond as a pure peak detector, however. An article entitled "The Dynamics of Compression: Some Key Elements Explored", published in the November 1993 issue of *The Hearing Journal* explains that the human ear behaves more like an average detector. That is, the perceived loudness of a signal depends more on the signal's average level than it does on the signal's peaks. Accordingly, peak detection circuitry, which adjusts the loudness of an entire signal based on the signal's peaks, may not adequately compensate for hearing deficiencies as can average detectors.

Unlike peak detectors, most prior art average detectors have not provided separate attack and release times. Prior art average detectors which have attempted to implement independent attack and release times have failed, however, to adequately increase the intelligibility of normal speech.

As a general rule, consonants within spoken words provide more distinguishing information than vowels. Individuals with hearing deficiencies often have more difficulty hearing consonants than vowels. Such individuals therefore have difficulty understanding normal speech. This difficulty is due, in large part, to the fact that consonants are spoken at relatively higher frequencies and lower volumes than vowels, paralleling the range of audible sound frequently lost by hearing impaired individuals.

An ideal hearing aid therefore would accentuate consonants without also emphasizing vowels, thereby increasing the intelligibility of normal speech for hearing impaired individuals. Such an ideal aid should attack transitions from softer consonants to louder vowels quickly to de-emphasize vowels sounds within a word, and it should also release quickly at transitions from vowels to consonants to accentuate consonants. The desired increased speed of release must be balanced against avoiding pumping the input signal. Thus, in an ideal aid, only a portion of the gain should be restored quickly and the remainder should be restored at a slower rate. The ideal aid would react quickly enough to emphasize low volume, high frequency consonant sounds without amplifying them enough to cause pumping.

Prior art hearing aids that use average detection have not achieved this ideal response. Instead of first releasing a portion of gain quickly and then slowing down, prior art hearing aids release at a constant rate. Prior art hearing aids, thus, fail to adequately accentuate consonants and therefore fail to adequately increase the intelligibility of normal speech.

As stated previously, loud sounds are heard by many hearing impaired individuals at the same sound level as individuals with normal hearing. Hearing aid users will experience discomfort if sounds reaching their ears are amplified too much. Through signal compression, prior art hearing aids provide reduced gain for loud sounds. Even compressed sounds may be amplified to uncomfortably loud levels, however, depending upon both the listener and listening environment.

Prior art hearing aids provide adjustable volume controls to reduce or increase the overall system gain. Thus, if a user is in a loud environment or is overly sensitive to loud sounds, the user may turn down the hearing aid volume. By doing so, however, the user also changes the gain for soft sounds. By lowering the volume to avoid uncomfortably loud sounds, the prior art hearing aid user also sacrifices the gain necessary to hear soft sounds.

Since loud sounds are heard by many hearing impaired individuals at the same sound level as individuals with normal hearing, hearing aid users likely prefer to amplify loud sounds with unity gain. Prior art hearing aids can only provide unity gain for loud sounds at one particular volume control setting. The gain for soft sounds cannot be set independently.

SUMMARY OF THE INVENTION

The invention provides a circuit usable in a hearing aid for compensating for the hearing deficiencies of a hearing impaired individual. In one embodiment the device utilizes an averaging detector that produces a signal indicative of a time-average value of an electrical input signal (such as may be received from a microphone). One or more compression amplifiers are provided, each receiving and compressing a component of the electrical input signal when the averaging signal exceeds a predetermined threshold value, producing a compressed signal which is supplied to an output transducer. Each compression amplifier has a variable gain. In a preferred embodiment a single compression amplifier is used, the entire input signal being provided to the compression amplifier.

The circuit also includes a plurality of time constant means (typically two) connected to the averaging detector which provide diverse time constants. The diverse time constants together produce a compression control signal which is used to control the gain of each compression amplifier. The compression control signal has an attack and release time. The attack time preferably is shorter than the release time. The release time of the compression control signal is proportional to the duration of time during which the averaging signal's amplitude exceeds the predetermined threshold level. In addition, desirably the release has a variable recovery rate, the recovery rate being relatively fast during an initial portion of the release time and relatively slower during the remaining portion of the release time.

The invention also relates to the use of a volume control in a signal processing circuit usable in hearing aids. In such a circuit an input signal (such as would be received from a microphone or other suitable source) is provided to a linear amplifier, which amplifies the signal at a fixed gain to produce a linearly amplified signal supplied to an output transducer. Typically the linear amplifier will have substantially unity gain. The input signal is also provided to one or more compression amplifiers, each of which receives a component of the input signal and has variable gain dependent upon the input signal (if only one compression amplifier is used, the entire input signal is provided to this amplifier). Each compression amplifier compresses its respective component of the input signal (or, in the case on one compression amplifier, compresses the entire input signal) to produce a compressed signal. An adjustable volume control is provided to adjust the gain of the one or more compressed signals without adjusting the gain of the linearly amplified signal to produce a volume adjusted signal, the volume adjusted signal being supplied to the output transducer along with the linearly amplified signal. This circuit therefore avoids amplification of loud sounds (reducing or eliminating the attendant "clipping" experienced by prior art devices) while providing desired amplification for softer sounds. The user is able to adjust the level of amplification of the softer sounds without substantially affecting the degree of amplification of loud sounds. Since soft sounds are often inaudible to the hearing impaired, this soft sound volume control may be set to closely match an individual's unique hearing loss, and typically will not need to be adjusted as the individual moves from noisy to quieter environments.

DETAILED DESCRIPTION OF THE INVENTION

Figure 1:
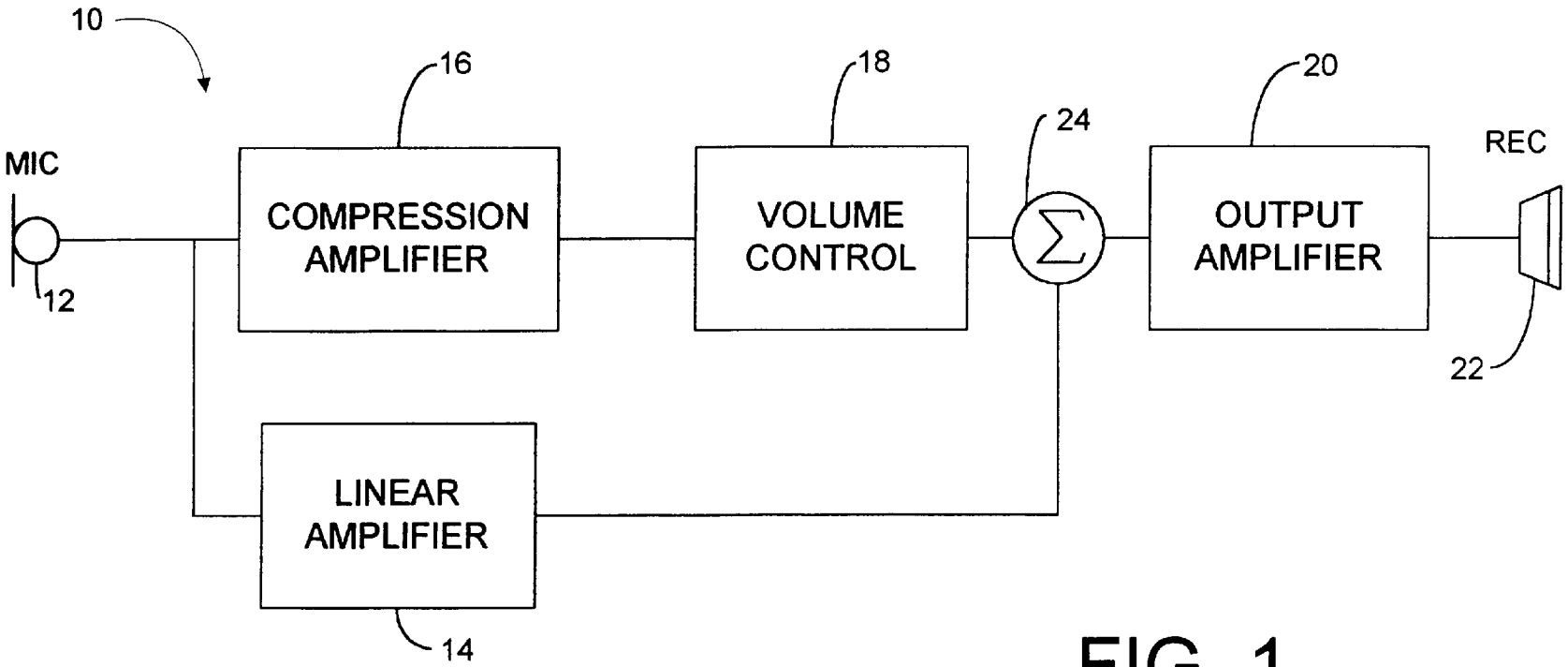
FIG. 1 is a block diagram of a hearing aid system of the invention.

The drawings depict, in various views and positions, preferred embodiments of the hearing aid device of the invention. It will be understood, however, that many of the specific details of the hearing aid device illustrated in the drawings could be changed, modified or even eliminated in some cases by one of ordinary skill in the art without departing significantly from the spirit of the invention.

FIG. 1 shows a block diagram of the components of a preferred embodiment of the hearing aid device 10 of the invention. The components of the device 10 are small enough to allow the device 10 to be worn inside the ear of a hearing impaired user. The device 10 is comprised of an input transducer shown as a microphone 12 that converts acoustic inputs or sound into a corresponding electrical input signal. The device 10 also includes a linear amplifier 14 that is electrically coupled to the microphone and receives the input signal. The linear amplifier 14 amplifies the input signal linearly with a fixed gain, producing a linearly amplified signal. The fixed gain of the preferred embodiment is typically set at substantially unity. Thus, the linear amplifier 14 essentially reproduces the input signal. Depending on a user's hearing loss, however, it may be advantageous to set the fixed gain at a level other than unity.

The device 10 also includes a compression amplifier 16 that compresses the input signal as the acoustic input signal's sound level increases. The characteristics of the compression amplifier 16 will be described in greater detail below.

Referring again to FIG. 1, the compression amplifier 16 produces a compressed signal that is supplied to an adjustable volume control 18. As will be explained below, it is important that only the compressed signal and not the linearly amplified signal flows into the adjustable volume control 18. The adjustable volume control 18 progressively attenuates the compressed signal, depending on how the volume is adjusted, to produce a volume adjusted signal. The volume may be adjusted in several possible ways. The preferred embodiment has a manually rotatable dial (not shown) external to the hearing aid device 10 which a user of the device 10 can rotate to effect a volume adjustment. The volume adjustment may also be effected by means of a set screw that is adjusted by a trained audiologist or possibly a remote control that transmits the desired volume adjustment via an RF wave.

Figure 2A:
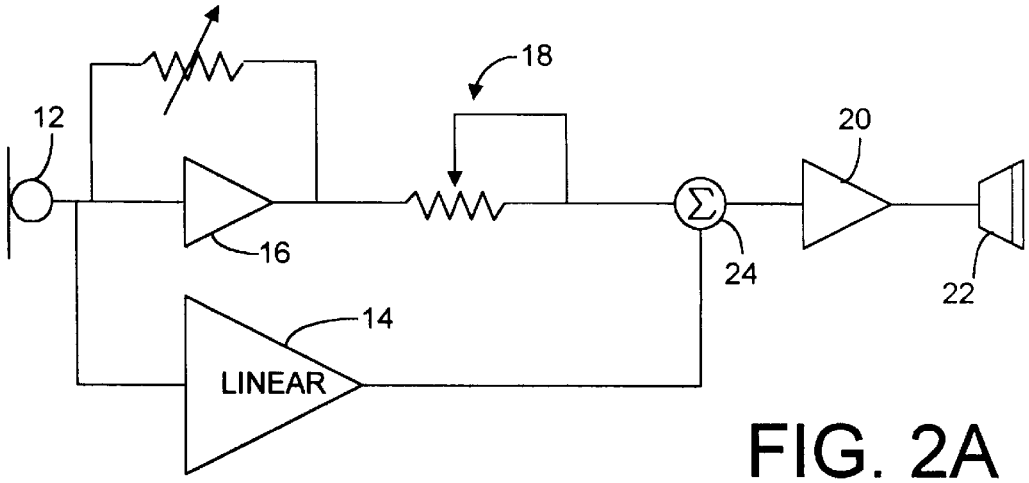
FIGS. 2A–2C are schematic diagrams of the hearing aid system of FIG. 1, illustrating different volume control circuits.
Figure 2B:
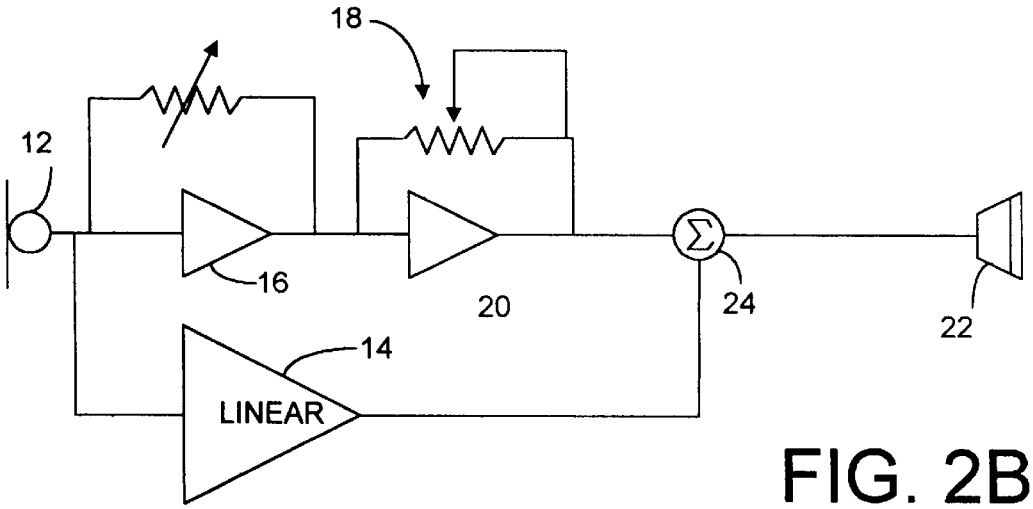
Figure 2C:
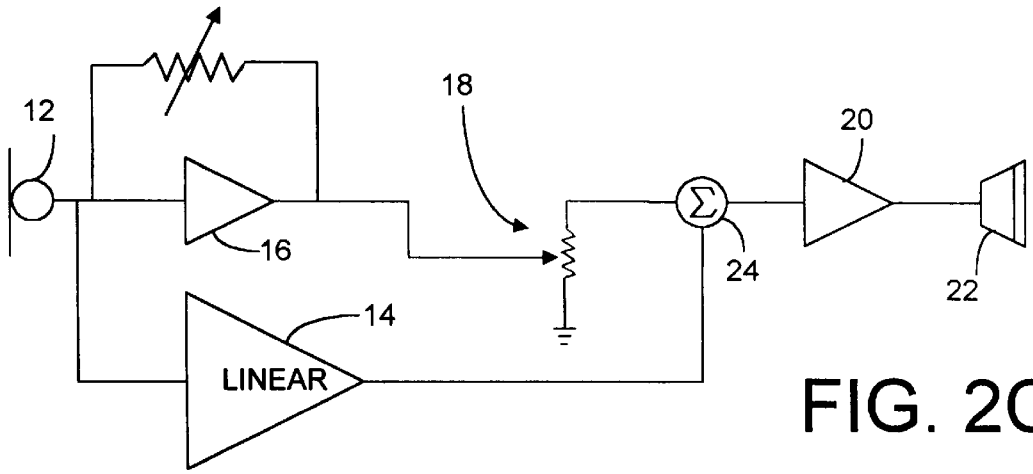

Various circuit configurations may be used to implement the adjustable volume control 18. Three examples of possible circuit configurations are shown in FIGS. 2A–2C. Similar to FIG. 1, each of these figures shows the hearing aid device 10 of the present invention, the microphone 12, the linear amplifier 14, and the compression amplifier 16 (shown as an automatic gain control element). Each adjustable volume control 18 configuration is shown in phantom. FIG. 2A shows a "series resistance" volume control providing adjustable attenuation of the compressed signal. FIG. 2B shows "feedback" volume control providing adjustable amplification of the compressed signal. FIG. 2C shows a "voltage divider" volume control providing, similar to "series resistance" volume control, an adjustable attenuation of the compressed signal.

The hearing aid device 10 also includes an output amplifier 20 or power amplifier for amplifying its received signal before the signal is conveyed to an output transducer or receiver 22, as shown in any of FIGS. 1, 2A–2C. The output amplifier 20 provides a fixed, linear gain. The receiver 22 converts its received electrical signal into an acoustic signal or sound wave for transmission to the ear of the user of the hearing aid device 10.

The present invention need not include a microphone 12 or a receiver 22. In an alternative embodiment, the microphone 12 and the receiver 22 may be replaced by other suitable means that convey acoustic information to the hearing aid user. For instance, in the case of a direct implant, an output transducer may be eliminated entirely. In addition, if the desired acoustic information is broadcast via an RF wave, the microphone 12 may be replaced by a suitable RF receiver.

Figure 3:
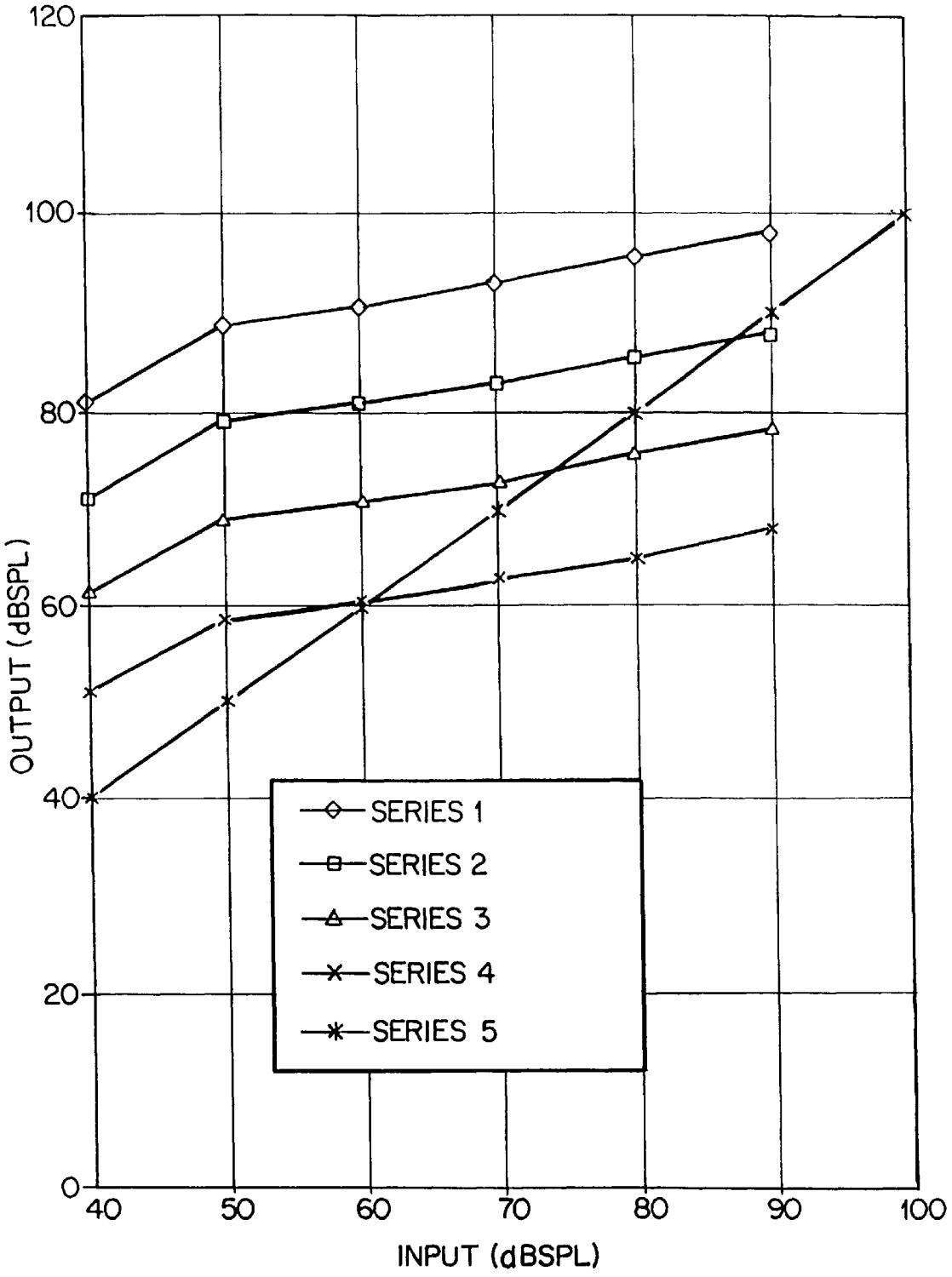
FIG. 3 is a graph illustrating the input/output performance of a typical compression amplifier at various volume control settings.
Figure 4:
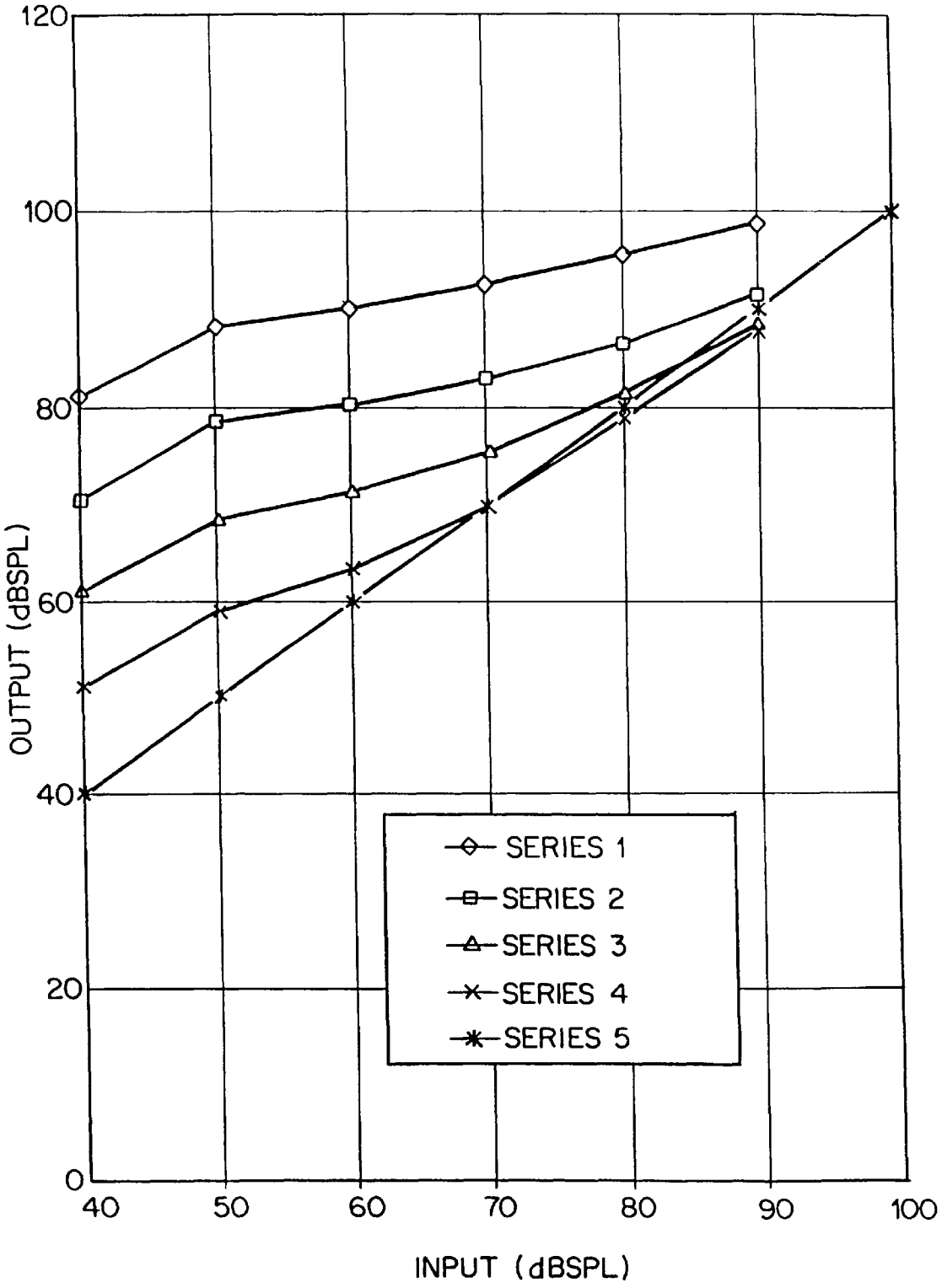
FIG. 4 is a graph illustrating the input/output performance of a circuit of the invention at various volume control settings.

In operation, the microphone 12 receives and converts acoustic signals into an electrical input signal. The input signal is provided to both a linear and a compression signal path. In the linear path, a linear amplifier 14 amplifies the input signal with unity gain to form a linearly amplified signal. The Series 5 curve in FIG. 3 and FIG. 4 shows the input/output (I/O) characteristics of the linear amplifier 14 set with unity gain. In the compression path, a compression amplifier 16 compresses the input signal, as will be explained later, and supplies a compressed signal to the adjustable volume control 18. The Series 3 curve in FIG. 3 shows a typical I/O response characteristic of the compression amplifier 16. Depending on the volume adjustment, the adjustable volume control 18 will progressively attenuate the compressed signal to form a volume adjusted signal. The Series 2 and 1 curves in FIG. 3 show how the entire I/O response curve of the compression amplifier 16 is shifted higher as the volume is incrementally increased. The Series 4 curve shows how the entire compression amplifier 16 I/O response curve is shifted lower when the volume is decreased. The linear and compression paths converge as the volume adjusted signal is combined with the linearly amplified signal in what is symbolically shown as a summing means 24. The summing means 24 may just be an electrical coupling of the signals into a unitary signal.

Just as the individual signals are summed, the individual I/O response curves may be summed to show the combined I/O response of the linear and compression paths. The series of curves in FIG. 4 show this combined response for several volume settings. The curves vary from full volume, shown as Series 1, to progressively lower volume shown as Series 2 and Series 3, and then finally to least volume, shown as Series 4. Note how the I/O response converges to unity gain, shown as Series 5, as the volume decreases. Also note that, independent of the volume setting, the combined I/O response converges to unity gain as the input becomes louder. In essence, the volume control boosts the device 10 gain above unity for softer inputs and leaves the device 10 gain at unity for louder inputs. By reducing the gain for louder signals to unity, the device 10 can sustain louder signal inputs without "clipping" or distorting the signal. The junction or transition between the device's soft and loud sound response may be considered a loud signal threshold, whereby inputs above the threshold are amplified with only unity gain. Adjusting the volume control therefore correspondingly adjusts the level of the loud signal threshold.

The audible range of many hearing impaired individuals is compressed to a limited dynamic range of sound. For such individuals, soft sounds may be inaudible while loud sounds are heard at the same sound level as persons with normal hearing. Hearing aid users will experience discomfort if sounds reaching their ears are amplified too much. Hearing aid users, therefore, likely prefer that loud sounds be amplified with only unity gain. Prior art hearing aids can only provide unity gain for loud sounds at one particular volume control setting. The gain for soft sounds cannot be set independently.

The hearing aid device 10, however, provides unity gain for loud sounds independent of the volume setting. In addition, by adjusting the volume control 18, the user of the device 10 adjusts the gain for soft sounds only. The user enjoys the benefit of amplifying otherwise inaudible soft sounds without the burden of overamplifying loud sounds. In addition, by adjusting the device's loud signal threshold, users of the device 10 "tune" the device to match their own hearing loss. Thus, instead of resetting the volume control for each listening environment, as is required by the prior art hearing aid, the adjustable volume control 18 need only be adjusted until it matches the user's own loud signal threshold.

Depending on the hearing aid user's hearing loss, it may be advantageous to set fixed gain of the linear amplifier 14 at a level other than unity. The setting chosen should remain substantially below the maximum gain of the compression amplifier 16. The I/O response of the device 10 would then converge to the chosen gain of the linear amplifier 14 as the volume is decreased. The combined I/O response would, accordingly, converge to the chosen gain, independent of the volume setting, as the input becomes louder.

Referring back to FIG. 1, the combined signal coming from the summing means 24 is amplified by the output amplifier 20 with a fixed gain and then supplied to the receiver 22. The receiver 22 converts the processed signal into an acoustic signal for transmission to the ear of the hearing aid user.

Figure 5:
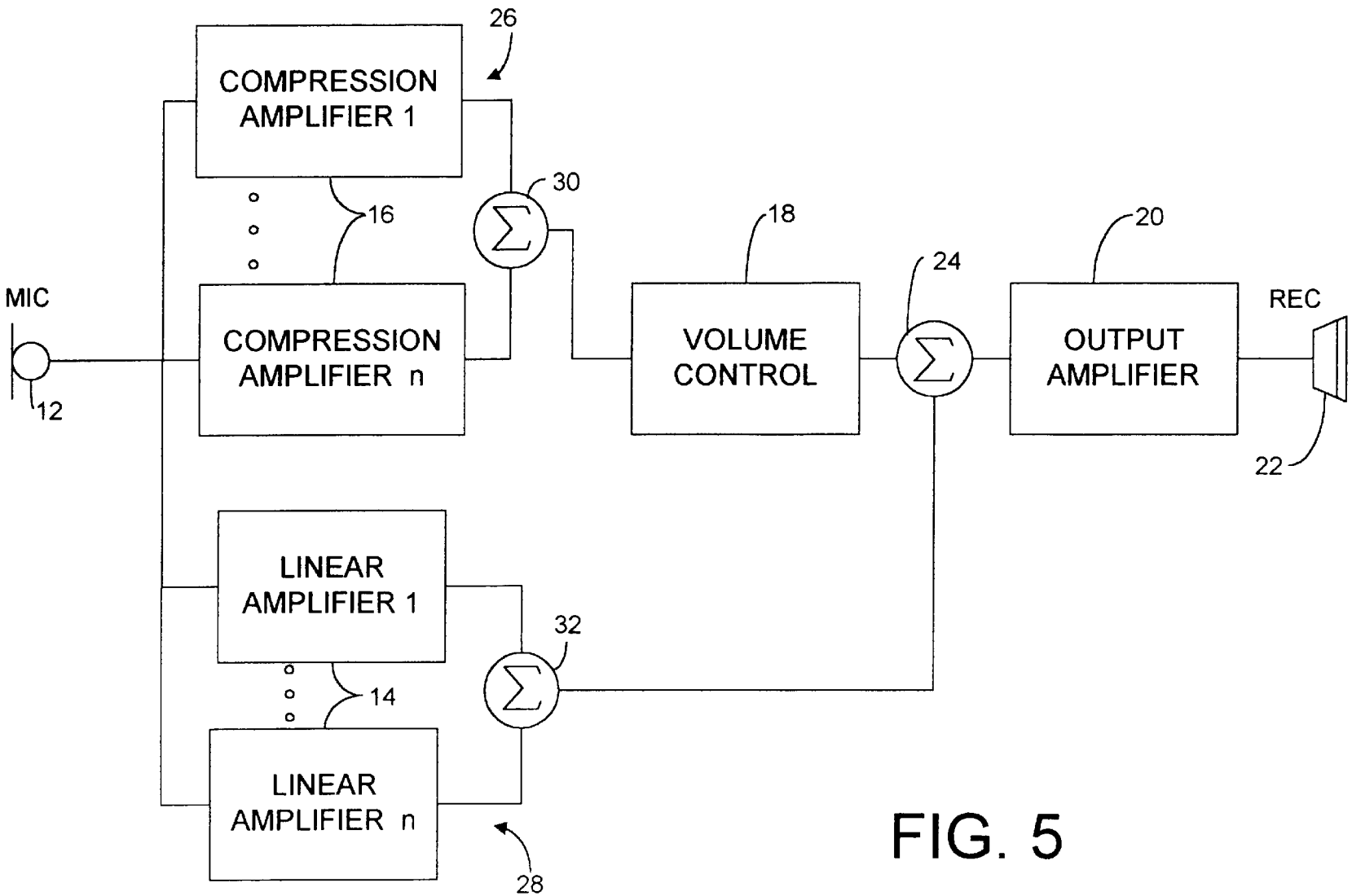
FIG. 5 is a block diagram of an alternate embodiment of the hearing aid system of FIG. 1.

Depending upon a user's hearing loss, it may be advantageous to replace the compression amplifier 16 and the linear amplifier 14 of the embodiment shown in FIG. 1 with a series 26 of compression amplifiers 16 and a series 28 of linear amplifiers, respectively, as shown in FIG. 5. The series of compressed signals produced by the series 26 of compression amplifiers 16 are summed by a summing means 30 before being supplied to the adjustable volume control 18. Similarly, the series of linearly amplified signals produced by the series 28 of linear amplifiers 14 are summed by a summing means 32 to produce a linearly amplified signal. Like the previous embodiment of the present invention, the linearly amplified signal of the present embodiment is not adjusted by the volume control. The present embodiment therefore provides the user with ability to adjust the volume of soft sounds independent of the volume of loud sounds. In addition, each compression amplifier 16 in the series 26 and each linear amplifier 14 in the series 28 may be configured with different I/O responses. By doing so, the hearing aid's I/O response characteristic may be set to more particularly match its user's hearing loss.

Figure 6:
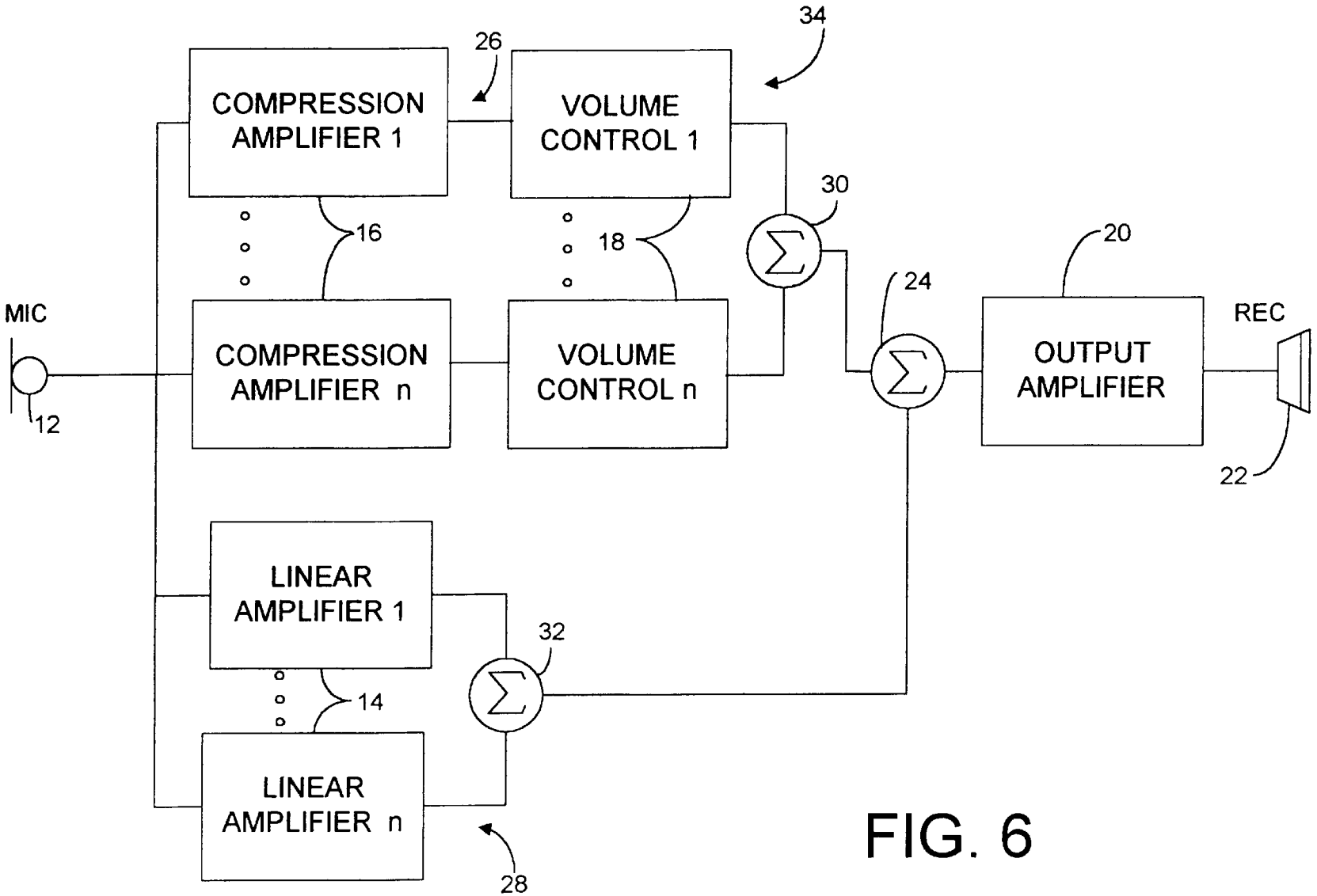
FIG. 6 is a block diagram of another alternate embodiment of the hearing aid system of FIG. 1.

Another embodiment of the present invention is shown in FIG. 6. Again, depending upon an individual's hearing loss, it may be advantageous to provide a series 34 of adjustable volume controls 18 or subcontrols, one for each compression amplifier 16. By doing so, the volume of each compressed signal coming from the series 26 of compression amplifiers 16 may be regulated independently to more particularly match the hearing loss of the user of the device 10.

Figure 7:
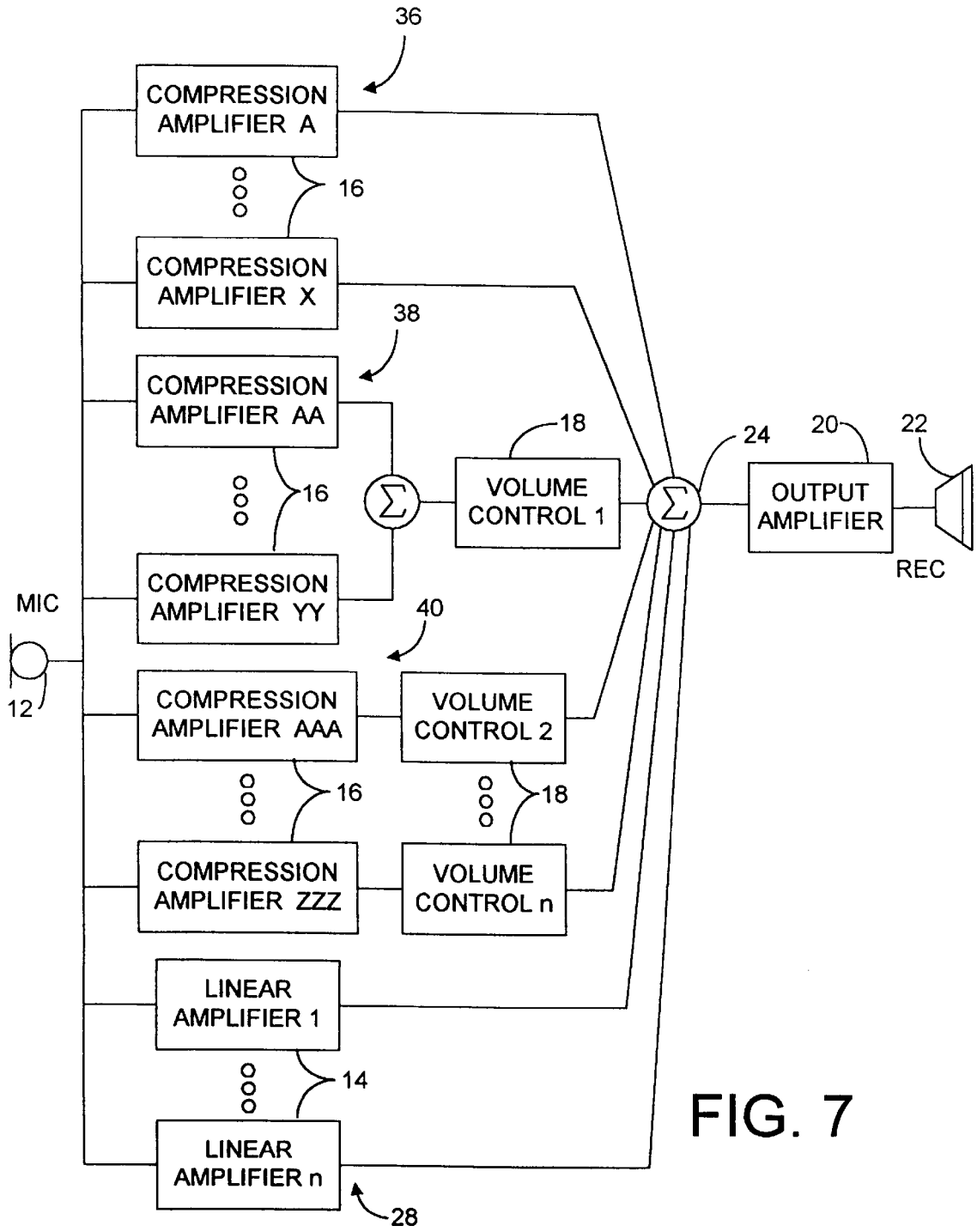
FIG. 7 is a block diagram of another alternate embodiment of the hearing aid system of FIG. 1.

Another variation of the present invention is shown in FIG. 7. In addition to a series 28 of linear amplifiers 14, first 36, second 38 and third 38 series of compression amplifiers 16 are included in this embodiment, each having a different volume adjustment. The compressed signals produced by the first 36 series of compression amplifiers are not volume adjusted. Those produced by the second 38 series of compression amplifiers are commonly adjusted by a single adjustable volume control 18. Finally, the compressed signals produced by the third 40 series are volume adjusted independently. The signals are then summed by the summing means 24. The compression amplifiers 16 of this embodiment may be configured with different I/O responses to more particularly match the hearing loss of the user of the device 10.

Figure 8:
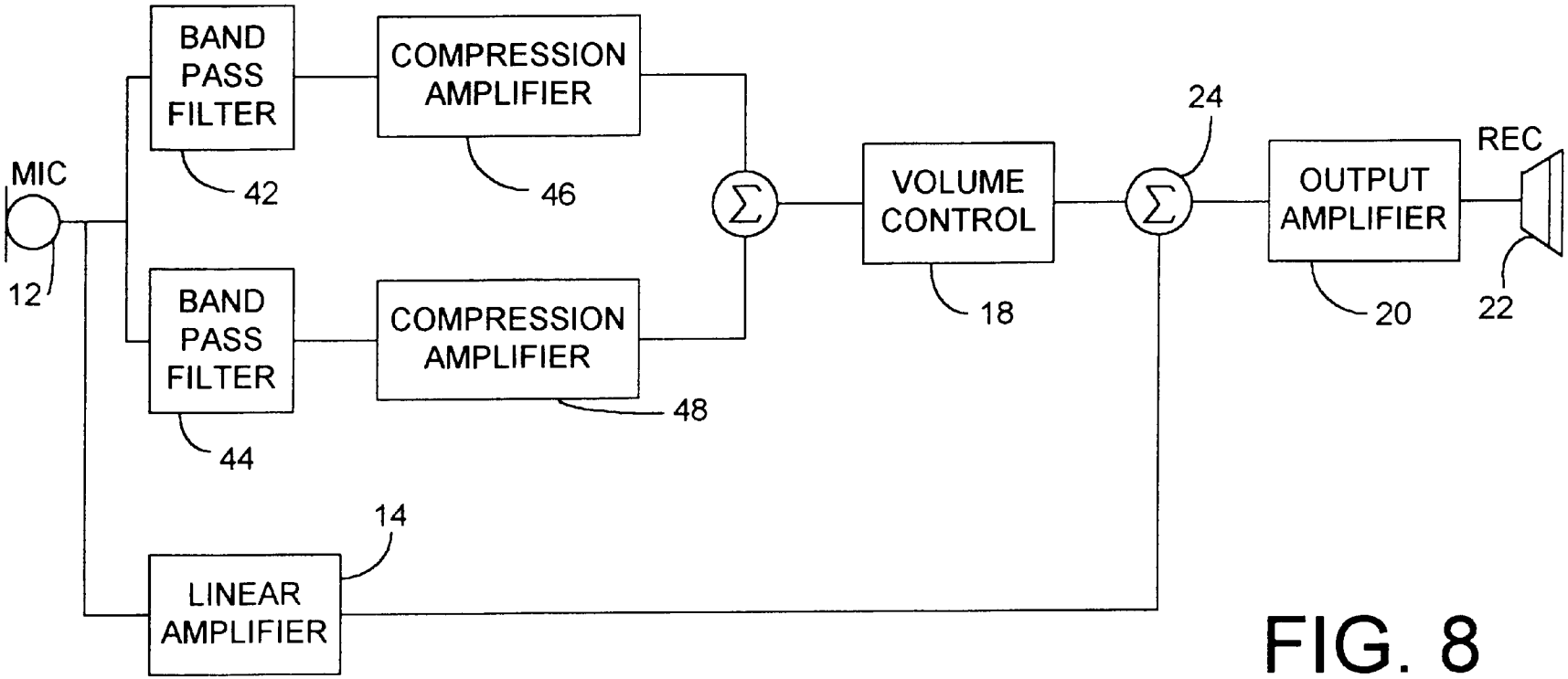
FIG. 8 is a block diagram of another alternate embodiment of the hearing aid system of FIG. 1.

Yet another embodiment of the device 10 is shown in FIG. 8. In this embodiment, the microphone 12 supplies the electrical input signal to a linear amplifier 14, and also to first 42 and second 44 bandpass filters. The first 42 and second 44 bandpass filters split the input signal into two components, a high (or "treble") frequency band and a low (or "bass") frequency band. If desired, a band split filter with an adjustable crossover frequency may be substituted for the bandpass filters to achieve the same effect. The high frequency band is amplified by a first compression amplifier 46 and the low frequency band signal is amplified by a separate, second compression amplifier 48. Hearing impaired individuals often have greater difficulty hearing high frequency sounds. To compensate for this difficulty, the first compression amplifier 46 preferably provides generally greater gain than the second compression amplifier 48. Similar to the previous embodiments, an adjustable volume control 18 adjusts the gain of only the compressed signals, not the linearly amplified signals. The present embodiment, like previous embodiments, therefore provides the user with the ability to adjust the volume of soft sounds independent of the volume of loud sounds.

Figure 9:
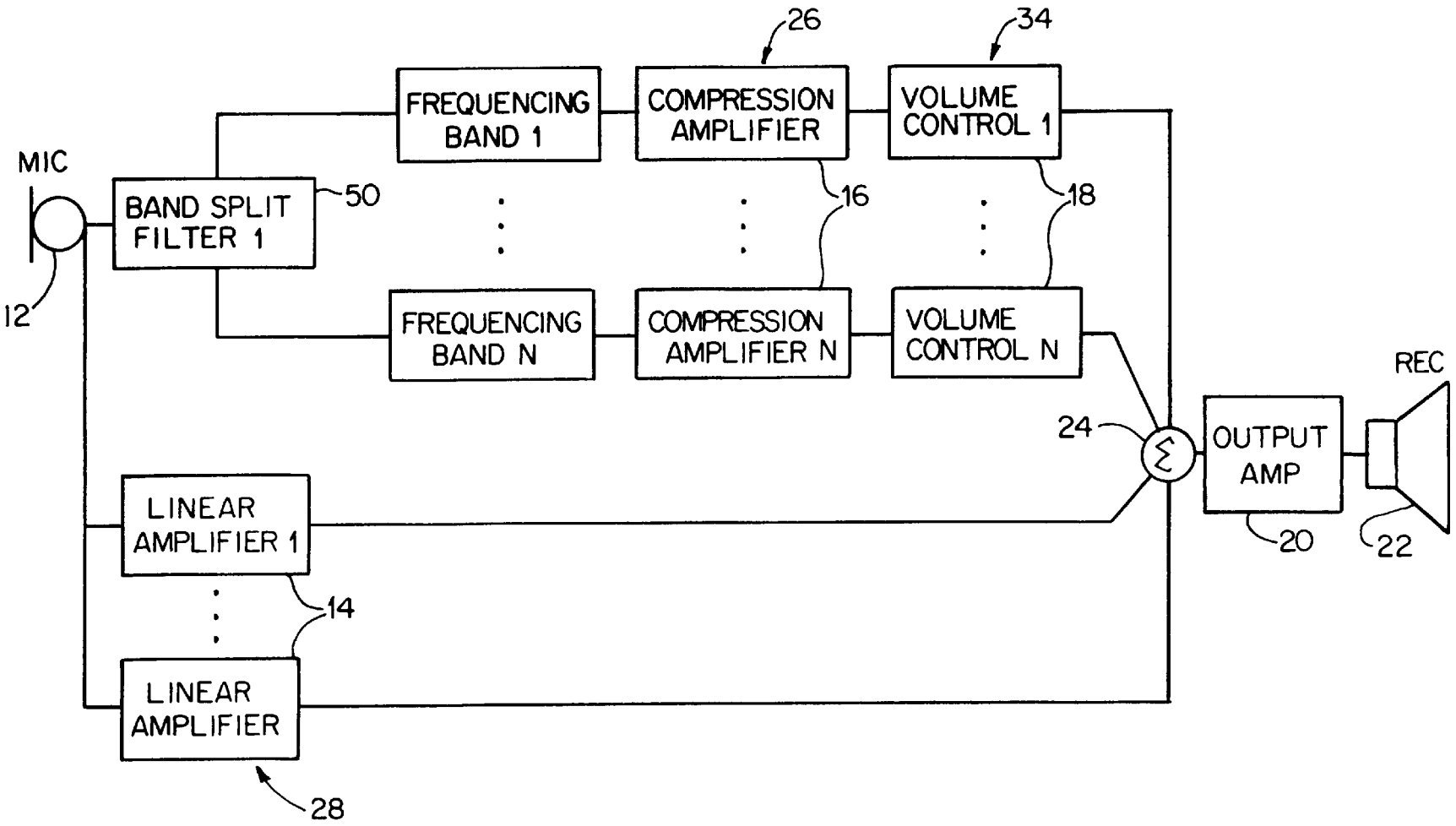
FIG. 9 is a block diagram of another alternate embodiment of the hearing aid system of FIG. 1.

A further embodiment of the device 10 is shown in FIG. 9. Depending upon an individual's hearing loss, it may be advantageous to add certain features to the previous embodiment. In the embodiment shown in FIG. 9, the linear amplifier 14 of the previous embodiment is replaced with a series 28 of linear amplifiers 14. In addition, the first and second band pass filters of the previous embodiment are replaced with a band split filter 50 that divides the input signal into a series of frequency bands. Likewise, the first and second compression amplifiers are replaced with a series 26 of compression amplifiers 16, and the single volume control is replaced with a series 34 of adjustable volume controls 18, one for each compression amplifier 16. The volume of each compressed signal may then be regulated independently to more particularly match the hearing loss of the user of the device 10.

Figure 10:
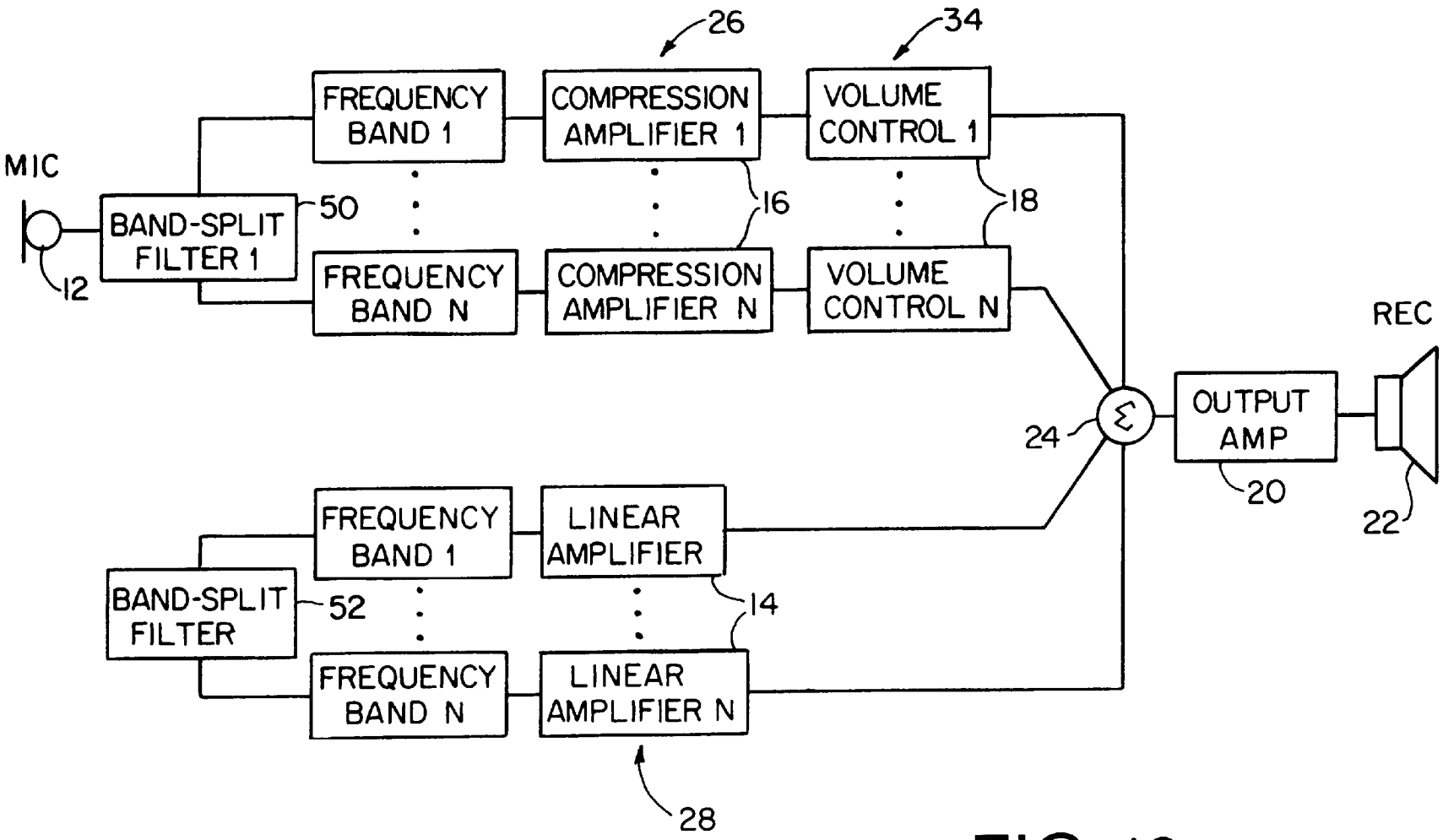
FIG. 10 is a block diagram of another alternate embodiment of the hearing aid system of FIG. 1.

A variation on this embodiment is shown in FIG. 10. Depending upon an individual's hearing loss, it may be advantageous to add a second band split filter 52 to the linear path of the previous embodiment. The second band split filter 52 divides the input signal into a series of frequency band components, one band for each linear amplifier 14. Since hearing impaired individuals often have greater difficulty hearing high frequency sounds, the higher frequencies may be amplified with greater gain.

Figure 11:
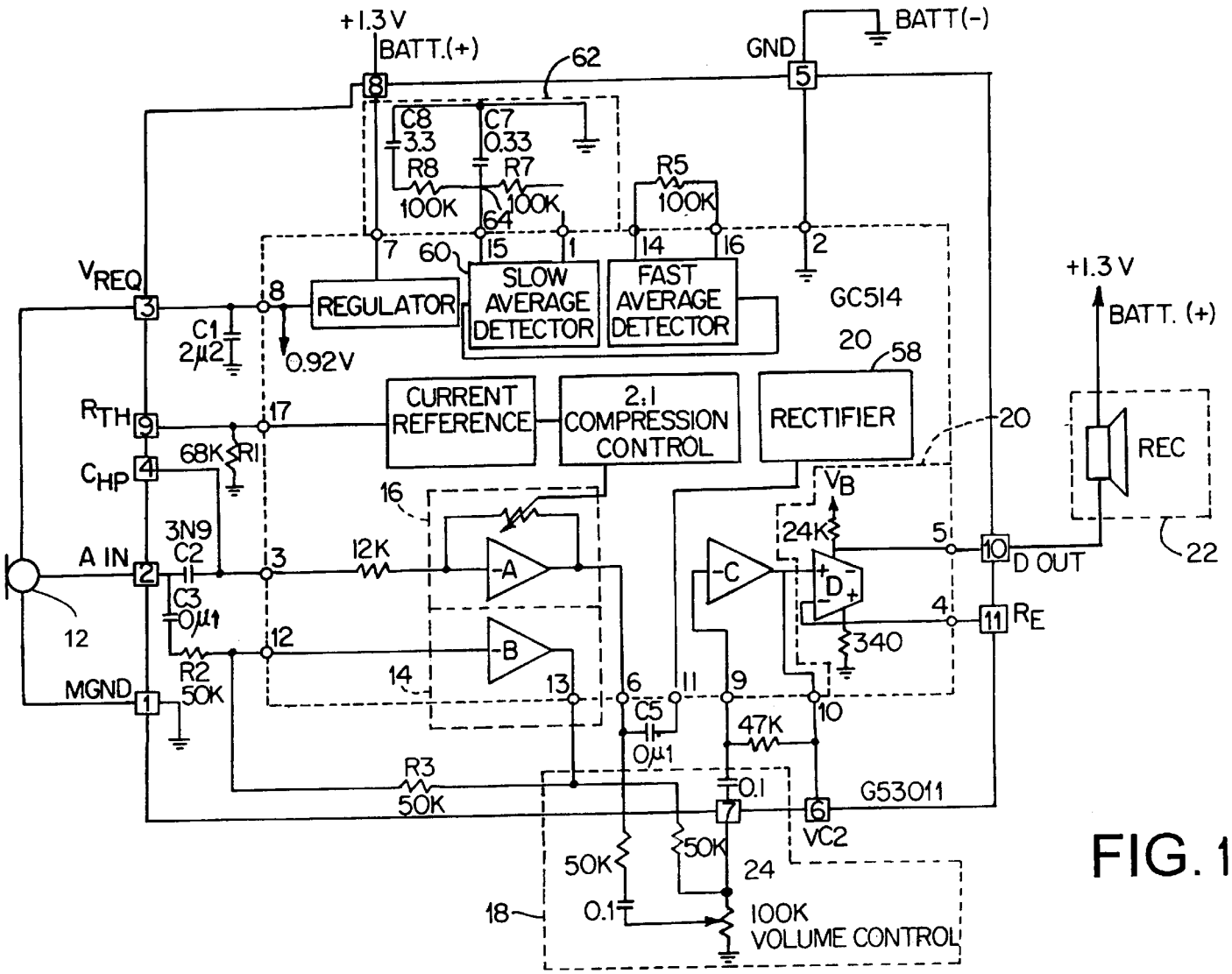
FIG. 11 is a schematic and block diagram of a preferred circuit of the invention.

Various circuit configurations may be used to implement the hearing aid device 10 of the present invention. One such configuration is shown in FIG. 11. This circuit configuration utilizes a commercially available integrated circuit (available from Gennum Corp. of Burlington, Ontario, Canada), the Gennum DynamEQ-I GC514 (shown in phantom) to provide some of the components of the first embodiment of the device 10. For instance, the linear amplifier 14, compression amplifier 16 and output amplifier 20 (all shown in phantom) are located on this IC. However, these components could be replaced with individual circuit elements. For instance, a simple lead wire may be substituted for the linear amplifier 14 since its gain is typically set at unity in the present invention. The microphone 12, receiver 22, and adjustable volume control 18, however, are not located on the IC. The adjustable volume control 18 shown in FIG. 11 is the "voltage divider" circuit configuration from FIG. 2*c*.

In addition to providing the user with the ability to adjust the volume of soft sounds independent of the volume of loud sounds, the hearing aid device 10 of the present invention also provides a unique compression system to further increase the intelligibility of normal speech. The compression amplifier system of the present invention is comprised of a compression amplifier 16, shown as a variable gain element in FIG. 11, level detection circuitry 54, and a gain controller 56, shown as a compression control in FIG. 11. The preferred embodiment uses the compression amplifier 16 on the Gennum IC. However, other compression amplifiers may be used including wide dynamic range amplifiers or compression limiting amplifiers.

Figure 12:
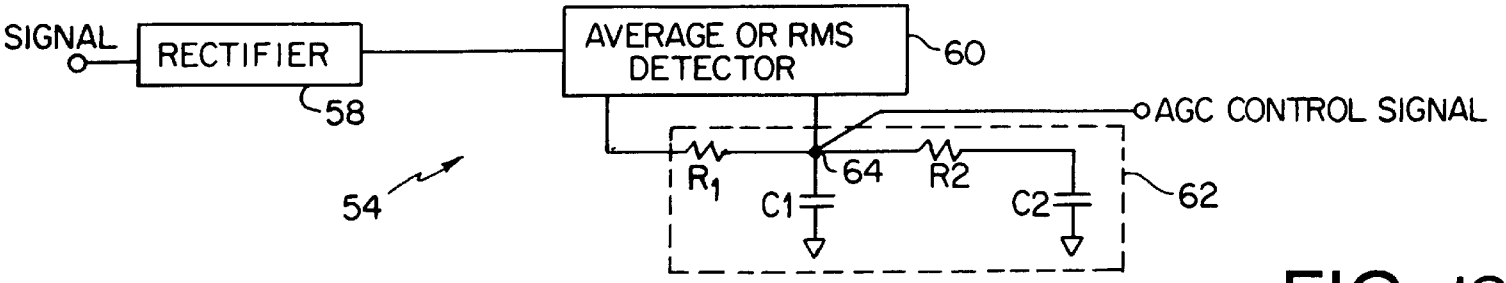
FIG. 12 is a schematic and block diagram of a portion of the circuit illustrated in FIG. 11.

In general, level detection circuitry measures an input voltage and generates a control voltage that a gain controller uses to set the gain of a variable gain element, or compression amplifier. The unique level detection circuitry 54 of the hearing aid device 10 is shown in FIG. 12. The signal out of the compression amplifier 16 is coupled to the level detection circuitry 54. Alternatively, the level detection circuitry could measure the input signal or a some component thereof instead of the compression amplifier 16 signal. The level detection circuitry 54 includes a rectifier 58, an average detector 60, and time constant means 62.

The preferred embodiment utilizes the rectifier 58 located on the Gennum IC. However, other rectifiers 58 may be used including any half-wave or full-wave rectifier. The preferred embodiment uses the Gennum chip's "Slow Average Detector" as an average detector 60. The Gennum chip's "Fast Average Detector" is not used in the preferred embodiment and is effectively disabled by shorting it to ground. In addition to Gennum's average detectors, other average detectors which provide some time-average value of the input signal may be used. Examples of useful time-average values of the input signal include the root-mean-square value or the fluctuating voltage level of a resistor-capacitor smoothing circuit.

The time constant means 62, shown in FIG. 12, are provided by a series of at least two resistor-capacitor networks, R1-C1 and R2-C2. The R-C component values in the preferred embodiment are 100 k Ohms for R1 and R2, 0.33 microfarads for C1, and 3.3 microfarads for C2. Other suitable component values may be substituted, however.

The level detection circuitry 54 generates a control voltage at terminal 64 that the gain controller uses to set the gain of the compression amplifier 16.

In operation, the compression amplifier system of the hearing aid device 10 receives the input signal from the microphone 12. As the input signal level increases sharply, the compression amplifier will momentarily amplify the input signal by its present gain. The signal out of the compression amplifier 16 is coupled to the level detection circuitry 54. Once in the level detection circuitry 54, the rectifier 58 will rectify the signal. Next, the average detector 60 will generate a time-average value of the rectified signal and supply the averaged signal to the time constant means 62. Capacitors C1 and C2 will charge and discharge in accordance with their respective time constants. In the preferred embodiment, the time constant for C1 is much shorter than that for C2. The voltage on C1 will therefore rise towards the level of the averaged signal much faster than C2. When the voltage on C1 rises to a level such that the voltage on terminal 64 exceeds a predetermined threshold level, the gain controller 56 reacts and reduces the gain of the compression amplifier 16. The attack time for the compression amplifier system of the device 10 is in the range of about 1 to 300 milliseconds, and more preferably in the range of about 1 to 20 milliseconds. The gain must be reduced quickly to avoid uncomfortable sound levels, and minimize overload or distortion.

Even though the charge on Cl has taken control of the level detection circuitry 54, C2 will continue to charge during this time period.

Figure 13:
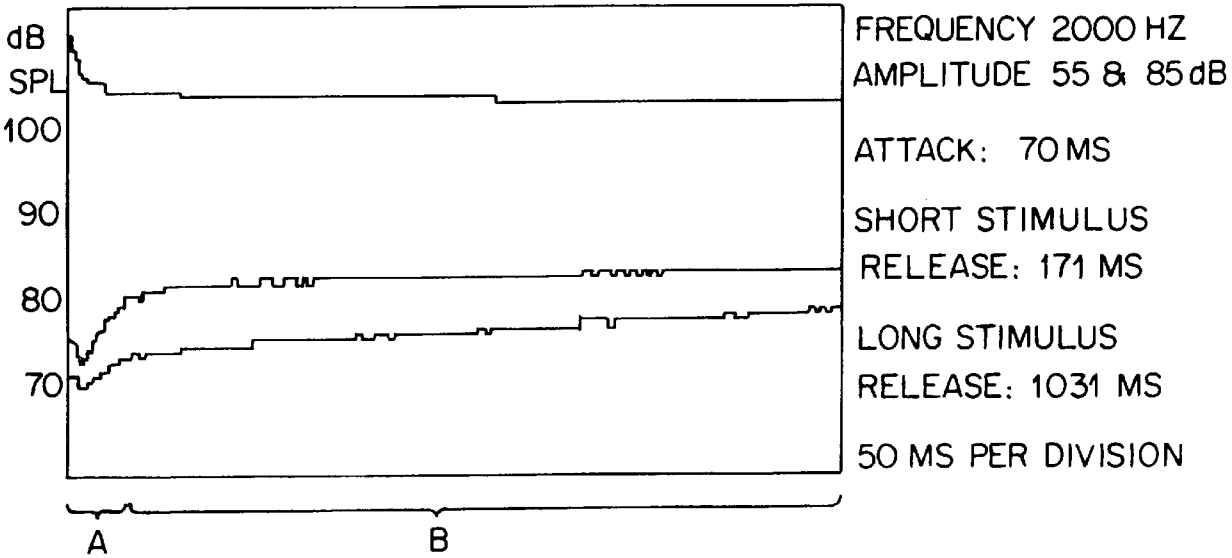
FIG. 13 is a graph illustrating the gain recovery of a circuit operating in accordance with the hearing aid system of the invention.

If the input signal level decreases sharply, the compression amplifier will momentarily amplify the input signal by its present gain. Since this softer signal will have a lower average value, the average detector 60 will supply a reduced signal to the time constant means 62. The voltage on C1 will fall towards the level of the averaged signal much faster than C2. C1 will therefore discharge relatively quickly through terminal 64 to the gain controller 56. The gain controller 56 reacts and quickly restores about 6 dBSPL of gain to the compression amplifier 16. C2 will discharge more slowly, thereby causing the gain controller 56 to restore the remainder of the gain more slowly than it restored the initial portion of the gain. Thus, the release has a variable release or recovery rate. FIG. 13 shows the trajectory of a typical release. During an short, initial portion of the release time, shown as interval "A" in FIG. 13, 6 dBSPL of gain is recovered quickly. The remainder of the gain is released over a longer time period, shown as interval "B" in FIG. 13.

Preferably, the release time is proportional to the duration of the period of time during which the amplitude of the averaging signal exceeds the predetermined threshold level. The release time is between 20 to 500 milliseconds for input signals of about 100 milliseconds and between 500 to 1500 milliseconds for input signals of about 2000 milliseconds.

The compression amplification system of the present invention possesses several advantages. First, the variable gain depends on the input signal's average value instead of its peaks. It is currently believed that the human ear behaves more like an average detector than a peak detector, and thus, the perceived loudness of a signal depends more on the signal's average level than it does on the signal's peaks. Accordingly, average detection is believed to compensate for hearing deficiencies better than peak detection. Second, even though average detection is employed, the compression system of the present invention provides independent attack and release times. Third, the fast attack and release times of the present invention generally do not cause an undesirable amount of audible "pumping" of the input signal. Release time is not long enough to produce audible gaps in the acoustic output signal. Fourth, the compression system of the present invention is believed to increase the intelligibility of normal speech. The system quickly attacks transitions from softer consonants sounds to louder vowels to de-emphasize vowels sounds within a word. It also releases quickly at transitions from vowels to consonants to accentuate information-bearing consonants. This fast speed of release is balanced against avoiding pumping the input signal varying the recovery rate. Only a portion of the gain is restored quickly and the remainder is restored at a slower rate. The device acts quickly enough to emphasize low volume, high frequency consonant sounds without completely releasing which can cause pumping.

The compression system of the present invention is not limited for use only in this first embodiment. In each of the other various embodiments shown in FIGS. 1, 5–11, the compression amplifier 16 of this first embodiment was replaced with at least two compression amplifiers 16. Besides providing additional compression amplifiers 16, it may be advantageous to provide separate sets of level detection circuitry 54 and gain controllers 56 for each compression amplifier 16. Thus, instead of varying the gain based on the entire input signal, the gain of each compression amplifier 16 would depend only upon the particular component of the input signal the amplifier 16 receives. Accordingly, low frequency signal received by one compression amplifier need not be amplified at the same level as a high frequency signal received by a different compression amplifier. In addition, each compression amplifier's attack and release time could then be set independently, thereby allowing greater flexibility in compensating for its user's hearing loss.

While several preferred embodiments of the present invention have been described, it should be understood that various changes, adaptations and modifications may be made therein without departing from the spirit of the invention and the scope of the appended claims.

What is claimed is:

1. A hearing aid device for the compensation of hearing deficiencies of a hearing impaired individual comprising:

an input transducer for converting acoustic energy into an electrical input signal;

an output transducer for converting received electrical signals into an acoustic output signal;

a linear amplifier for receiving the input signal and amplifying it at a fixed gain to produce a linearly amplified signal;

one or more compression amplifiers each receiving and amplifying a respective component of the input signal to produce a compressed signal, each compression amplifier having variable gain, the linearly amplified signal being supplied to the output transducer without being received or amplified by the one or more compression amplifiers; and an adjustable volume control receiving the one or more compressed signals without receiving the linearly amplified signal and adjusting the gain of the one or more compressed signals without adjusting the gain of the linearly amplified signal to produce a volume adjusted signal, the volume adjusted signal being supplied to the output transducer.

2. The hearing aid device of claim 1 wherein the fixed gain of the linear amplifier is substantially unity.

3. The hearing aid device of claim 1 wherein the fixed gain of the linear amplifier is substantially less than a maximum gain of each compression amplifier.

4. The hearing aid device of claim 1 wherein the variable gain of each of the one or more compression amplifiers is dependent upon the component of the input signal received.

5. The hearing aid device of claim 1 wherein the variable gain of each of the one or more compression amplifiers is dependent upon the one or more compressed signals.

6. The hearing aid device of claim 1 wherein the device has only one compression amplifier, and the component of the input signal it receives is substantially the input signal.

7. The hearing aid device of claim 1 comprising two or more compression amplifiers.

8. The hearing aid device of claim 7 wherein the volume control is common to the compression amplifiers providing a common adjustment of the gain for all the compression amplifiers.

9. The hearing aid device of claim 7 wherein the volume control is comprised of one or more regulators each providing independent adjustment of the respective gains of each of the one or more compressed signals.

10. The hearing aid device of claim 7 further comprising two or more bandpass filters for receiving the input signal and supplying to the respective compression amplifiers the respective components of the input signal, each respective component of the input signal being a different frequency band of the input signal.

11. The hearing aid device of claim 10 further comprising one or more fixed gain amplifiers each receiving the input signal and amplifying it at a fixed gain to produce a fixed gain amplified signal, each fixed gain amplified signal being supplied to the output transducer.

12. The hearing aid device of claim 1 further comprising one or more fixed gain amplifiers each receiving the input signal and amplifying it at a fixed gain to produce a fixed gain amplified signal, each fixed gain amplified signal being supplied to the output transducer.

13. The hearing aid device of claim 12 wherein the volume control is comprised of one or more regulators each providing independent adjustment of the respective gains of each of the one or more compressed signals.

14. The hearing aid device of claim 13 further comprising a first set of one or more compression amplifiers, each compression amplifier of the first set of one or more compression amplifiers having variable gain and receiving and amplifying a respective component of the input signal to produce a fixed volume signal which is supplied to the output transducer.

15. The hearing aid device of claim 14 further comprising a second set of one or more compression amplifiers, each compression amplifier of the second set of one or more compression amplifiers having a variable gain and receiving and amplifying a respective component of the input signal to produce a common volume signal, and further comprising an adjustable common volume control common to all the compression amplifiers of the second set of one or more compression amplifiers to provide a common adjustment of the gain for all the common volume signals to produce a common volume adjusted signal, the common volume adjusted signal being supplied to the output transducer.

16. The hearing aid device of claim 1 further comprising a first set of one or more linear amplifiers, each linear amplifier of the first set of one or more linear amplifiers receiving a respective component of the input signal and amplifying it at a fixed gain to produce a variable volume linearly amplified signal, and wherein the adjustable volume control adjusts the gain of each variable volume linearly amplified signal to produce a linearly adjusted signal, the linearly adjusted signal added to the volume adjusted signal.

17. The hearing aid device of claim 1 further comprising an adjustable loud signal threshold such that input signals below the loud signal threshold are amplified at least unity gain and input signals above the loud signal threshold are amplified at substantially unity gain.

18. The hearing aid device of claim 17 wherein the volume control adjusts the loud signal threshold.

19. The hearing aid device of claim 1 wherein the one or more compression amplifiers each comprises wide dynamic range compression amplifiers.

20. The hearing aid device of claim 1 further comprising an averaging detector for generating an averaging signal indicative of a time-average value of the one or more compressed signals, a plurality of time constant means coupled to the averaging detector providing diverse time constants which together produce a compression control signal, the compression control signal progressively reducing the gain of each compression amplifier as the averaging signal exceeds a predetermined threshold level, the compression control signal having a relatively shorter attack and a relatively longer release time, the release time being proportional to the duration of the period of time during which the amplitude of the averaging signal exceeds the predetermined threshold level, the release time having a variable release rate being relatively faster during an initial portion of the release time and relatively slower during a remaining portion of the release time, and wherein the variable gain of each compression amplifier is dependent upon the compression control signal.

21. The hearing aid device of claim 20 wherein the time-average value of the one or more compressed signals is defined as the root-mean-square of the one or more compressed signals.

22. The hearing aid device of claim 20 wherein the averaging detector comprises a capacitor and a resistor coupled in series to a rectifier, and a means for computing an arithmetic mean of the input signal.

23. The hearing aid device of claim 20 wherein the plurality of time constant means include a plurality of capacitors and resistors.

24. The hearing aid device of claim 20 in which there are at least first and second time constant means.

25. The hearing aid device of claim 20 in which there are at least two different time constants.

26. The hearing aid device of claim 20 wherein the plurality of time constant means are provided by a plurality of resistor-capacitor networks coupled to the average detector.

27. The hearing aid device of claim 20 wherein the average detector exhibits the characteristics of a Gennum DynamEQ-1 GC514 integrated circuit slow average detector.

28. The hearing aid device of claim 20 wherein the attack time is in the range of about0.001–0.3 seconds and the release time is in the range of about 0.02–0.5 seconds for input signals of about 0.1 seconds and of about 0.5–1.5 seconds for input signals of about 2.0 seconds.

29. A hearing aid device for the compensation of hearing deficiencies of a hearing impaired individual comprising:

an input transducer for converting acoustic energy into an electrical input signal;

an output transducer for converting received electrical signals into an acoustic output signal;

a linear amplifier for receiving the input signal and amplifying it at a fixed gain to produce a linearly amplified signal;

one or more compression amplifiers each receiving and amplifying a respective component of the input signal to produce a compressed signal and having a variable gain, the linearly amplified signal being supplied to the output transducer without being received or amplified by the one or more compression amplifiers; and an adjustable volume control receiving the one or more compressed signals without receiving the linearly amplified signal and adjusting the gain of the one or more compressed signals without adjusting the gain of the linearly amplified signal to produce a volume adjusted signal, the volume adjusted signal being supplied to the output transducer.

30. A hearing aid device for the compensation of hearing deficiencies of a hearing impaired individual comprising:

an input transducer for converting acoustic energy into an electrical input signal;

an output transducer for converting received electrical signals into an acoustic output signal;

a linear amplifier for receiving the input signal and amplifying it at unity gain to produce a linearly amplified signal;

two or more compression amplifiers each receiving and amplifying a respective component of the input signal to produce a compressed signal, the two or more compression amplifiers each having variable gain, the linearly amplified signal being supplied to the output transducer without being received or amplified by the two or more compression amplifiers;

two or more bandpass filters for receiving the input signal and supplying to the respective compression amplifiers the respective components of the input signal, each respective component of the input signal being a different frequency band of the input signal; and an adjustable volume control receiving the one or more compressed signals without receiving the linearly amplified signal and adjusting the gain of the two or more compressed signals without adjusting the gain of the linearly amplified signal to produce a volume adjusted signal, the volume adjusted signal being supplied to the output transducer.

31. A signal processing system for use in a hearing aid to compensate for hearing deficiencies of a hearing impaired individual, comprising:

a linear amplifier for receiving an input signal and amplifying it at a fixed gain to produce a linearly amplified signal;

one or more compression amplifiers each receiving and amplifying a respective component of the input signal to produce a compressed signal, the one or more compression amplifiers each having variable gain, the linearly amplified signal being supplied to an output without being received or amplified by the one or more compression amplifiers; and an adjustable volume control receiving the one or more compressed signals without receiving the linearly amplified signal and adjusting the gain of the one or more compressed signals without adjusting the gain of the linearly amplified signal to produce a volume adjusted signal, the volume adjusted signal being supplied to the output, thereby amplifying input signals below a loud signal threshold at at least unity gain and amplifying input signals above the loud signal threshold at substantially unity gain.

32. A signal processing system for use in a hearing aid to compensate for hearing deficiencies of a hearing impaired individual, comprising:

a linear amplifier for receiving an input signal and amplifying it at a fixed gain to produce a linearly amplified signal;

a compression amplifier for receiving and amplifying a respective component of the input signal to produce a compressed signal, the compression amplifier having variable gain, the linearly amplified signal being supplied to an output without being received or amplified by the compression amplifier; and an adjustable volume control receiving the compressed signal without receiving the linearly amplified signal and adjusting the gain of the compressed signal without adjusting the gain of the linearly amplified signal to produce a volume adjusted signal, the volume adjusted signal being supplied to the output, thereby amplifying input signals below a loud signal threshold at at least unity gain and amplifying input signals above the loud signal threshold at substantially unity gain.

33. A hearing aid device for the compensation of hearing deficiencies of a hearing impaired individual comprising:

an input transducer for converting acoustic energy into an electrical input signal;

an output transducer for converting received electrical signals into an acoustic output signal;

one or more compression amplifiers each receiving and amplifying a respective component of the input signal to produce a compressed signal which is supplied to the output transducer, each compression amplifier having variable gain dependent upon a compression control signal;

an averaging detector for generating an averaging signal indicative of a time-average value of the one or more compressed signals; and a plurality of time constant means coupled to the averaging detector providing diverse time constants which together produce the compression control signal, the compression control signal progressively reducing the gain of each compression amplifier as the averaging signal exceeds a predetermined threshold level, the compression control signal having a relatively shorter attack and a relatively longer release time, the release time being proportional to the duration of the period of time during which the amplitude of the averaging signal exceeds the predetermined threshold level, the release time having a variable release rate being relatively faster during an initial portion of the release time and relatively slower during a remaining portion of the release time.

34. The hearing aid device of claim 33 wherein the time-average value of the one or more compressed signals is defined as the root-mean-square of the one or more compressed signals.

35. The hearing aid device of claim 33 wherein the averaging detector comprises a capacitor and a resistor coupled in series to a rectifier, and a means for computing an arithmetic mean of the input signal.

36. The hearing aid device of claim 33 wherein the plurality of time constant means include a plurality of capacitors and resistors.

37. The hearing aid device of claim 33 in which there are at least first and second time constant means.

38. The hearing aid device of claim 33 in which there are at least two different time constants.

39. The hearing aid device of claim 33 wherein the plurality of time constant means are provided by a plurality of resistor-capacitor networks coupled to the average detector.

40. The hearing aid device of claim 33 wherein the average detector exhibits the characteristics of a Gennum DynamEQ-1 GC514 integrated circuit slow average detector.

41. The hearing aid device of claim 33 wherein the one or more compression amplifiers each comprises wide dynamic range compression amplifiers.

42. The hearing aid device of claim 33 wherein the attack time is in the range of about 0.001–0.3 seconds and the release time is in the range of about 0.02–0.5 seconds for input signals of about 0.1 seconds and of about 0.5–1.5 seconds for input signals of about 2.0 seconds.

43. The hearing aid device of claim 33 wherein the device has only one compression amplifier, and the component of the input signal it receives is substantially the input signal.

44. The hearing aid device of claim 33 further comprising:

a linear amplifier for receiving the input signal and amplifying it with a fixed gain to produce a linearly amplified signal, the linearly amplified signal being supplied to the output transducer; and an adjustable volume control for adjusting the gain of each compressed signal supplied to the output transducer without adjusting the gain of the linearly amplified signal.

45. The hearing aid device of claim 44 wherein the fixed gain of the linear amplifier is substantially unity.

46. The hearing aid device of claim 44 wherein the fixed gain of the linear amplifier is substantially less than a maximum gain of each compression amplifier.

47. The hearing aid device of claim 44 comprising two or more compression amplifiers.

48. The hearing aid device of claim 47 wherein the volume control is common to the compression amplifiers providing a common adjustment of the gain for all compression amplifiers.

49. The hearing aid device of claim 47 further comprising two or more bandpass filters for receiving the input signal and supplying to the respective compression amplifiers the respective components of the input signal, each respective component of the input signal being a different frequency band of the input signal.

50. The hearing aid device of claim 44 wherein the volume control includes a manually rotatable dial permitting a user to adjust the volume control.

51. The hearing aid device of claim 44 further comprising an adjustable loud signal threshold such that input signals below the loud signal threshold are amplified with at least unity gain and input signals above the loud signal threshold are amplified with substantially unity gain.

52. The hearing aid device of claim 51 wherein the volume control adjusts the loud signal threshold.

53. A hearing aid device for the compensation of hearing deficiencies of a hearing impaired individual comprising:

an input transducer for converting acoustic energy into an electrical input signal;

an output transducer for converting received electrical signals into an acoustical output signal;

a compression amplifier for receiving and amplifying the input signal to produce a compressed signal which is supplied to the output transducer, the compression amplifier having variable gain dependent upon a compression control signal;

an averaging detector for generating an averaging signal indicative of a time-average value of the compressed signal; and at least first and second time constant means provided by a plurality of resistors and capacitors, the at least first and second time constant means coupled to the averaging detector providing at least two different time constants which together produce the compression control signal, the compression control signal progressively reducing the gain of the compression amplifier as the averaging signal exceeds a predetermined threshold level, the compression control signal having a relatively shorter attack and a relatively longer release time, the release time being proportional to the duration of the period of time during which the amplitude of the averaging signal exceeds the predetermined threshold level, the attack time in the range of about 0.001–0.3 seconds and the release time in the range of about 0.02–0.5 seconds for input signals of about 0.1 seconds and of about 0.5–1.5 seconds for input signals of about 2.0 seconds, the release time having a variable release rate being very fast during an initial portion of the release time and relatively slow during a remaining portion of the release time.

54. A signal processing system for use in a hearing aid to compensate for hearing deficiencies of a hearing impaired individual, comprising:

one or more compression amplifiers each receiving and amplifying a respective component of an input signal to produce a compressed signal which is supplied to an output, each compression amplifier having variable gain dependent upon a compression control signal;

an averaging detector for generating an averaging signal indicative of a time-average value of the one or more compressed signals; and a plurality of time constant means coupled to the averaging detector providing diverse time constants which together produce the compression control signal, the compression control signal progressively reducing the gain of each compression amplifier as the averaging signal exceeds a predetermined threshold level, the compression control signal having a relatively shorter attack and a relatively longer release time, the release time being proportional to the duration of the period of time during which the amplitude of the averaging signal exceeds the predetermined threshold level, the release time having a variable release rate being relatively faster during an initial portion of the release time and relatively slower during a remaining portion of the release time.

55. A signal processing system for use in a hearing aid to compensate for hearing deficiencies of a hearing impaired individual, comprising:

a compression amplifier for receiving and amplifying an input signal to produce a compressed signal which is supplied to an output, the compression amplifier having variable gain dependent upon a compression control signal;

an averaging detector for generating an averaging signal indicative of a time-average value of the input signal; and a plurality of time constant means coupled to the averaging detector providing diverse time constants which together produce the compression control signal, the compression control signal progressively reducing the gain of the compression amplifier as the averaging signal exceeds a predetermined threshold level, the compression control signal having a relatively shorter attack and a relatively longer release time, the release time being proportional to the duration of the period of time during which the amplitude of the averaging signal exceeds the predetermined threshold level, the release time having a variable release rate being relatively faster during an initial portion of the release time and relatively slower during a remaining portion of the release time.

56. A hearing aid device for the compensation of hearing deficiencies of a hearing impaired individual comprising:

an input transducer for converting acoustic energy into an electrical input signal;

an output transducer for converting received electrical signals into an acoustic output signal;

one or more compression amplifiers each receiving and amplifying a respective component of the input signal to produce a compressed signal which is supplied to the output transducer, each compression amplifier having variable gain dependent upon a respective compression control signal;

one or more averaging detectors each generating an averaging signal indicative of a time-average value of the respective compressed signals; and a plurality of time constant means coupled to each averaging detector providing a plurality of sets of diverse time constants, the diverse time constants of each set of diverse time constants together defining the respective compression control signals, each compression control signal progressively reducing the gain of each respective compression amplifier as the respective averaging signal exceeds a predetermined threshold level, each compression control signal having a relatively shorter attack and a relatively longer release time, each release time being proportional to the duration of the period of time during which the amplitude of the respective averaging signal exceeds the predetermined threshold level, each release time having a variable release rate being relatively faster during an initial portion of the respective release time and relatively slower during a remaining portion of the respective release time.

57. A method of processing a hearing aid signal to compensate for the hearing deficiencies of a hearing impaired individual comprising:

converting acoustic energy received by an input transducer into an electrical input signal;

providing the electrical input signal to a first signal path having a fixed gain to produce a linearly amplified signal;

providing the electrical input signal to one or more compression signal paths, each of the one or more compression signal paths parallel to the first signal path, each of the one or more compression signal paths including a compression amplifier which amplifies the input signal to produce a compressed signal, each compression amplifier having variable gain;

volume adjusting each compressed signal without adjusting the gain of the linearly amplified signal in the first signal path to produce a volume adjusted signal in each of the one or more compression signal paths; and providing the volume adjusted signals and the linearly amplified signal to an output transducer.

* * * * *